US006910420B1

(12) United States Patent
Thompson et al.

(10) Patent No.: US 6,910,420 B1
(45) Date of Patent: Jun. 28, 2005

(54) ELECTRICAL INITIATION SYSTEM

(75) Inventors: Don Thompson, Ridgecrest, CA (US); George N. Hennings, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/378,133

(22) Filed: Mar. 4, 2003

(51) Int. Cl.[7] ..... F42B 3/10
(52) U.S. Cl. ..... 102/202.5
(58) Field of Search ..... 102/202.5

(56) References Cited

U.S. PATENT DOCUMENTS 4,881,463 A 11/1989 Ninio et al.
5,113,764 A * 5/1992 Mandigo et al. ..... 102/202.9
5,646,367 A 7/1997 Shanks et al.
5,717,159 A 2/1998 Dixon et al.
6,289,813 B1 * 9/2001 Duguet et al. ..... 102/202.5

* cited by examiner

*Primary Examiner*—Aileen Felton
(74) *Attorney, Agent, or Firm*—Charlene A. Haley

(57) ABSTRACT

An apparatus and method of using electrically initiated primer systems that rely on vaporizing a thin metallic film which is either coated on a non-conductive insulator component or is a malleable thin film or strip secured to the inner surface of a primer cup assembly to ignite an environmentally safe MIC composition.

29 Claims, 5 Drawing Sheets

ELECTRICAL INITIATION SYSTEM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention relates to electrically initiated primer systems, and more specifically, an electrical initiation technique that relies on substantially vaporizing a thin metallic film or strip to rapidly ignite a lead-free explosive composition.

BACKGROUND OF THE INVENTION

Electrically ignitable primers have been previously used in military applications for high speed firing of various sized caliber ordnance, in blasting for mining operations, for automotive crash bag initiation and inflation, seismic guns, kiln guns, rocket motors, and pyrotechnic displays. However, many of these primers are not suitable for small arms such as rifles, pistols, and shotguns. Typically, electrically ignitable primers have been initiated by exploding bridge wires or hot wires in combination with semiconductive mixture, pyrotechnic mix, or conductive mix. However, all of these electrical initiation systems suffer from relatively long ignition times. Both percussion and electrical primer compositions require expensive environmental handling procedures during both production and disposal. A primary concern is the amount of lead absorbed by humans from exposure to primer mix constituents, as well as the combustible by-products of lead-based primer compositions.

Primer mixes used in military ammunition must function reliably between the temperatures of −65° F. to +160° F. The reliability of current lead-free primer compounds degrade as temperatures approach −65° F. Attempts in improving the reliability of such primers has resulted in an increase in the hazards associated with their use in U.S. military weapons.

U.S. Pat. No. 5,717,159 issued on Feb. 10, 1998 to Dixon et al. teaches lead-free percussion primer mixes based on metastable interstitial (intermolecular) composite (MIC composition) technology. The lead-free percussion primer composition includes a mixture of about 45 weight % aluminum powders having an outer coating of aluminum oxide and molybdenum trioxide powder or a mixture of 50 weight % aluminum powders is having an outer coating of aluminum oxide and polytetrafluoroethylene powder (Teflon®). The percussion primer mix is initiated by squeezing it between the base of the primer cup and an anvil fitted at the top of the cup by mechanical force. This action forces the metal (fuel) and metal-oxide (oxidizer) together with sufficient force to initiate a localized exothermic chemical reaction. Due to the very small particle size and level of compaction, the reaction propagates very quickly.

Initiation of a MIC material requires bringing the metal (i.e., the fuel, which in this case is the aluminum) and the metal oxide (i.e., the oxidizer—in this case $MoO_3$) into close contact and in a quantity sufficient to sustain a reaction. Under normal conditions, this contact is prevented by the presence of an oxide film on the metal fuel. In the case of aluminum, the oxide adheres to the base metal with great tenacity and prevents oxygen from the oxidizer in reacting with the base metal even at elevated temperatures beyond the melting point. This method may work well with percussion cartridge primers; however, the method involved in the ignition of explosive materials operates quite differently in electrical initiation systems.

An electric igniter for artillery ammunition serves to ignite the primer charge of such ammunition. It typically includes a metal casing holding an initiator charge associated with an electric resistor. The resistor is electrically linked to a DC source and is further electrically linked to a contactor. Upon contact, the electric resistor is heated and initiator charge is ignited which further ignites the primer charge, usually via a booster charge. Although the approach just described works extremely well for explosive based cartridge primers, it is not applicable to MIC-based electrically initiated primers. Thus, because the metal particles that make up the powder have an oxide jacket, which is non-conductive, a MIC requires a different approach to initiate electrically.

From the foregoing, it will be appreciated that there is a need in the art for a lead-free electrical initiation system which is environmentally safe, provides primer mix that does not degrade as temperatures approached −65° F., and exhibits improved ignition times.

SUMMARY OF THE INVENTION

The present invention is electrically initiated primer systems that rely on vaporizing a thin metallic film to ignite an environmentally safe MIC composition. The first aspect of the present invention includes an electrical initiation system comprising: a lead-free MIC composition, and a primer cup assembly including a substantially non-conducting insulator, a metallized button, a metallized cup, and a metallized cup support. The insulator includes a thin film of metal, preferably made of aluminum; however any metal can be utilized with the present invention. The thin film of metal is dimensioned and configured to be in contact with the button, the primer cup, and the MIC composition. The MIC composition is filled into the primer cup assembly and an effective amount of electric energy is applied to the primer cup assembly to substantially vaporize the metallic film which ignites the MIC composition.

In another preferred embodiment of the present invention, a thin film electrical initiation system includes: a lead-free MIC composition; a primer cup assembly including a substantially non-conductive insulator, a metallized button, a metallized cup, and a metallized cup support; and at least one conductive adhesive. The MIC composition is filled into the primer cup assembly. At least one thin metallic film is secured (preferably glued) by the conductive adhesive to the inner surface of the primer cup assembly. The thin metallic film is dimensioned and configured to contact with the button, the primer cup, and the MIC composition. An effective amount of electric energy is applied to the primer cup assembly to substantially vaporize the metallic film which ignites the MIC composition.

In most preferred embodiment of the present invention, the MIC composition includes a metal fuel selected from the group consisting of a particulate $Al^1$, $Al^2$, $Al^3$, or titanium, and a metal oxidizer selected from the group consisting of molybdenum trioxide, copper oxide, and polytetrafluoroethylene. In addition, the MIC composition further includes carbon black, acetylene black, or like material.

The second aspect of the present invention includes a method for an electrical ignition system, including: providing a lead-free MIC composition; providing a primer cup assembly including a substantially non-conductive insulator, a metallized button, a metallized cup, and a metallized cup support; filling the primer cup with the MIC composition; providing at least one thin metallic film which is secured to the inner surface of the primer cup assembly, wherein the thin metallic film is dimensioned and configured to contact with the button, the primer cup and the MIC composition; and supplying an effective amount of electric energy which is applied to the primer cup assembly for electrical ignition. In this embodiment, no conductive adhesives are needed due to the compression of the MIC composition providing the necessary contact points of the thin metallic film between the MIC composition and the primer cup assembly. This aspect of the present invention further includes providing at least one adhesive in a conductive form, preferably, metallically filled which acts to secure each thin metallic film to the inner surface of the primer cup assembly to promote bottom and/or top initiation of the MIC composition.

It is an object of the present invention to provide a lead-free energetic composition fill for electrically initiated primers.

It is another object of the present invention to provide an electrical initiation system that relies on vaporizing a thin metallic film by supplying it with an effective amount of electric energy to ignite the MIC composition.

It is a further object of the present invention to strategically secure the microscopy conductive adhesive(s) and the thin metallic film to promote bottom and/or top initiation of energetic composition (MIC composition).

It is still a further object of the present invention to provide a nanometer particle size lead-free composition (MIC composition) and level of compaction so the localized exothermic chemical reaction propagates rapidly.

Still another object of the present invention is to provide a thin metallic film or metallic coated paper (or polyester strip, i.e. Mylar®) capable of igniting several different MIC compositions.

Still yet another object of a preferred embodiment of the present invention is to provide a low-cost, environmentally safe explosive composition for electrical ignition systems.

It is to be understood that the foregoing general description and the following detailed description are exemplary and explanatory only and are not to be viewed as being restrictive of the present invention, as claimed. These and other objects, features and advantages of the present invention will become apparent after a review of the following detailed description of the disclosed embodiments and the appended claims.

DETAILED DESCRIPTION OF THE INVENTION

Figure 1:
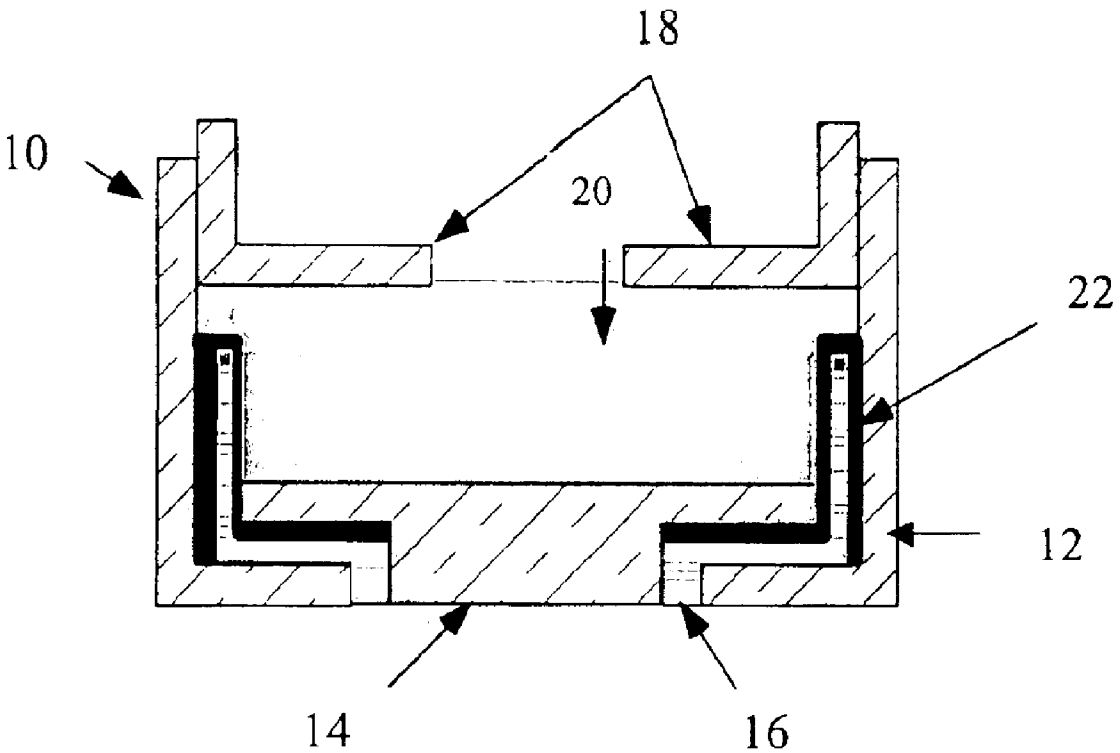
FIG. 1 illustrates a first embodiment of the electrical initiation system showing a metallized surface-coated insulator according to the present invention.

The present invention is a novel electrically initiated primer system that relies on vaporizing a thin metallic film to ignite a lead-free MIC composition. FIG. 1 illustrates one aspect of the most preferred embodiment of the present invention 10 which includes an electrical initiation system including: a lead-free MIC composition 20; and a primer cup assembly including a insulator 16, a metallized button 14, a metallized cup 12, thin metallic film 22 (shown in solid black line) and a metallized cup support 18. The insulator 16 includes a thin film of metal, preferably made of aluminum and is dimensioned and configured to be in contact with the button 14, the primer cup 12, and the MIC composition 20. The insulator is made of a non-conducting material selected from, but not limited to, the group consisting of polyvinylchloride, PEG, ceramic, plastic, and like materials. The MIC composition 20 is filled into the primer cup assembly and an effective amount of electric energy is applied to the primer cup assembly to substantially vaporize the metallic film to ignite the MIC composition 20. The insulator 16 includes a thin film of metal, preferably made of aluminum; however any metal can be utilized with the present invention.

Figure 2:
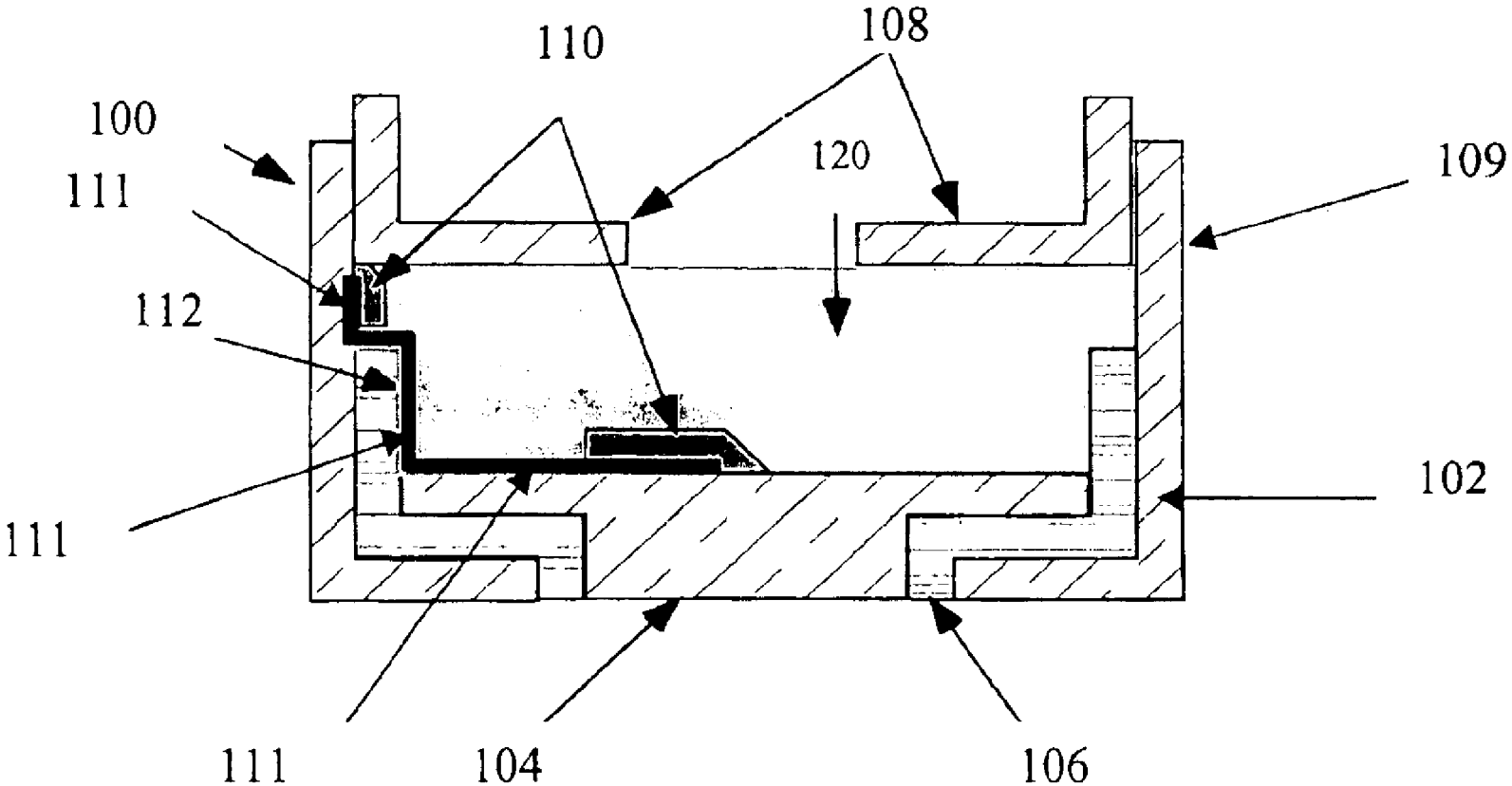
FIG. 2 illustrates a second embodiment of the electrical initiation system showing a thin metallic film secured to the inner surface of the primer cup assembly by microscopy conductive adhesives to the surface closest to the propellant to promote bottom initiation according to the present invention.
Figure 3:
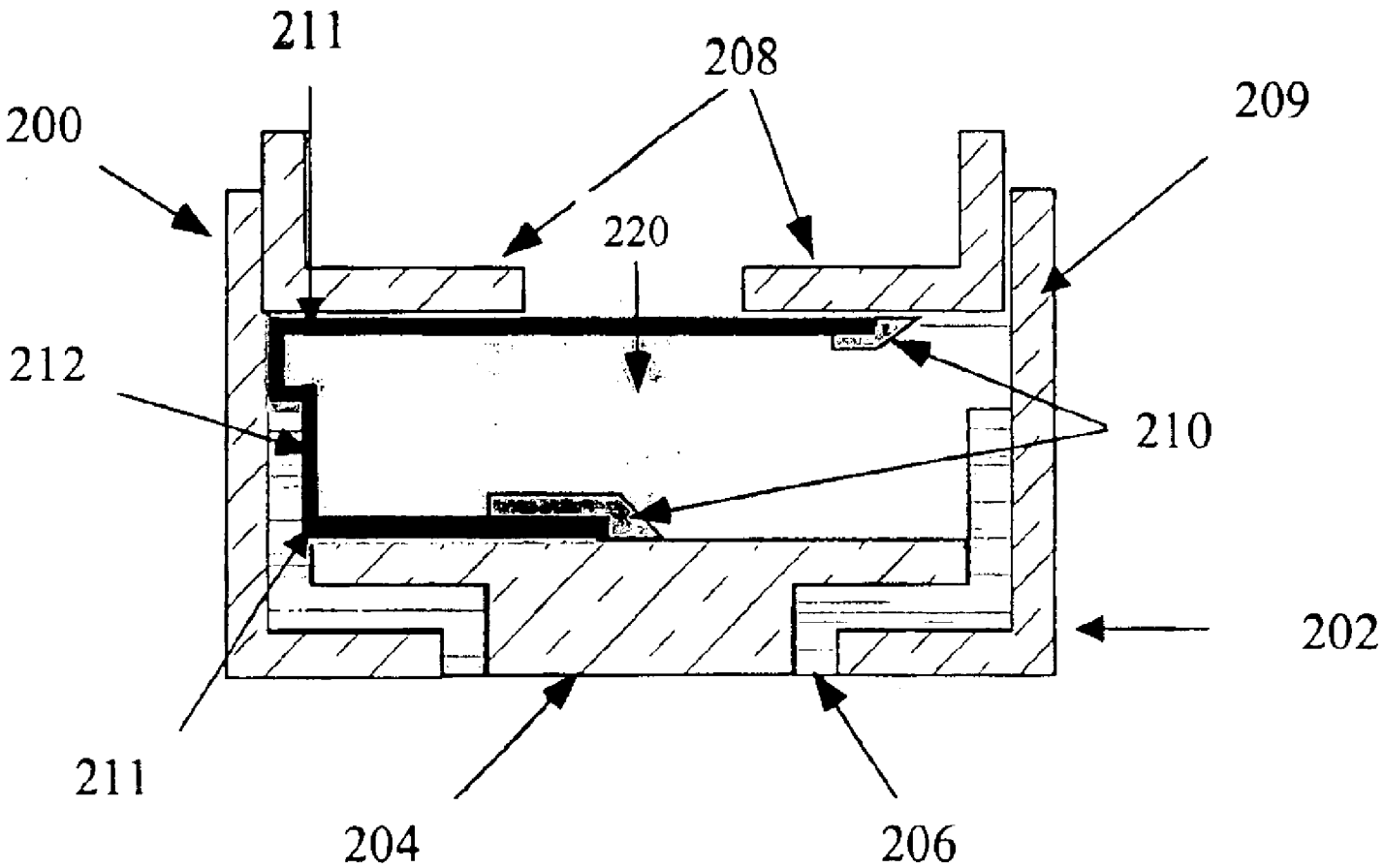
FIG. 3 illustrates a third embodiment of the electrical initiation system showing a thin metallic film secured to the inner surface of the primer cup assembly by microscopy conductive adhesives in a manner to promote both top and bottom initiation of the MIC composition.

Other preferred embodiments of the present invention 100 or 200 are shown in FIGS. 2 and 3. In these embodiments, the thin metallic film electrical initiation system 100 or 200 includes: a lead-free MIC composition 120 or 220; a primer cup assembly including a insulator 106 or 206, the primer cup assembly having an inner surface 111 or 211 and an outer surface 109 or 209, a metallized button 104 or 204, a metallized cup 102 or 202, and a metallized cup support 108 or 208; and at least one conductive adhesive 110 or 210. The MIC composition 120 or 220 is filled into the primer cup assembly. At least one thin metallic film 112 or 212 (shown in solid black line) is secured by the adhesive 110 or 210 to the primer cup assembly where the film 112 or 212 is dimensioned and configured to contact with the button 104 or 204, the primer cup 102 or 202, and the MIC composition 120 or 220. An effective amount of electric energy is applied to the primer cup assembly to substantially vaporize the metallic film 112 or 212 which ignites the MIC composition 120 or 220.

In most preferred embodiment of the present invention, the MIC composition includes a metal fuel and an oxidizer (preferably, a metal oxidizer). In addition, the MIC composition further includes carbon black or acetylene black. The MIC compositions of the present invention includes an effective amount of metal fuel selected from the group consisting of a particulate $Al^1$, $Al^2$, $Al^3$, titanium, and an effective amount of metal oxidizer selected from the group consisting of molybdenum trioxide, copper oxide, and polytetrafluoroethylene. Effective amounts of at least one oxidizer vary drastically in weight % and are used to oxide at least one metal fuel. However, one skilled in the art would be able to identify the effective amount ratios of metal fuel and oxidizer for the MIC composition. The thin film or strip can be deposited as either a coating (on the surface of a thin combustible material such as paper, polyester strip, or foil, or like materials) or as a malleable thin film or strip.

U.S. Pat. No. 5,717,159 issued to Dixon, et al., discloses many of the preferred MIC composition mixtures utilized in the present invention. As in the Dixon patent, the MIC composition of the present invention would include a mixture of aluminum powder and molybdenum trioxide or a mixture of aluminum powder and polytetrafluoroethylene (Teflon®). The particle sizes of the-powder are preferably about 0.1 $\mu$m or less, more preferably, from about 0.02–0.050 $\mu$m. For the Al/$MoO_3$ composition, aluminum typically constitutes about 45 weight % and $MoO_3$ typically constitutes about 55 weight % of the composition. Weight percentages for the Al/Teflon® combination are both about 50 weight %. However, various (weight percent) amounts of metal fuels and oxidizers can be utilized with the present invention and would depend on the type of metal fuels and oxidizers, type of electrical initiation system, and the amount of other components including carbon black and acetylene black. As noted earlier, primer mixes used in military ammunition must function reliably between the temperatures of −65° F. to +160° F. The reliability of current lead-free primer compounds degrade as temperatures approach −65° F. Attempts to improve the reliability of such primers has resulted in an increase in the hazards associated with their use in U.S. military weapons. The relative insensitivity of the MIC compositions of the present invention to low temperatures provides a MIC composition that will reliably function at temperatures as low as −65° F. With a cook off temperature that approaches 900° F., the MIC compositions far exceed the required high temperature requirement of +160° F. for the safe use in military ammunition.

TEST EXAMPLES

Figure 4:
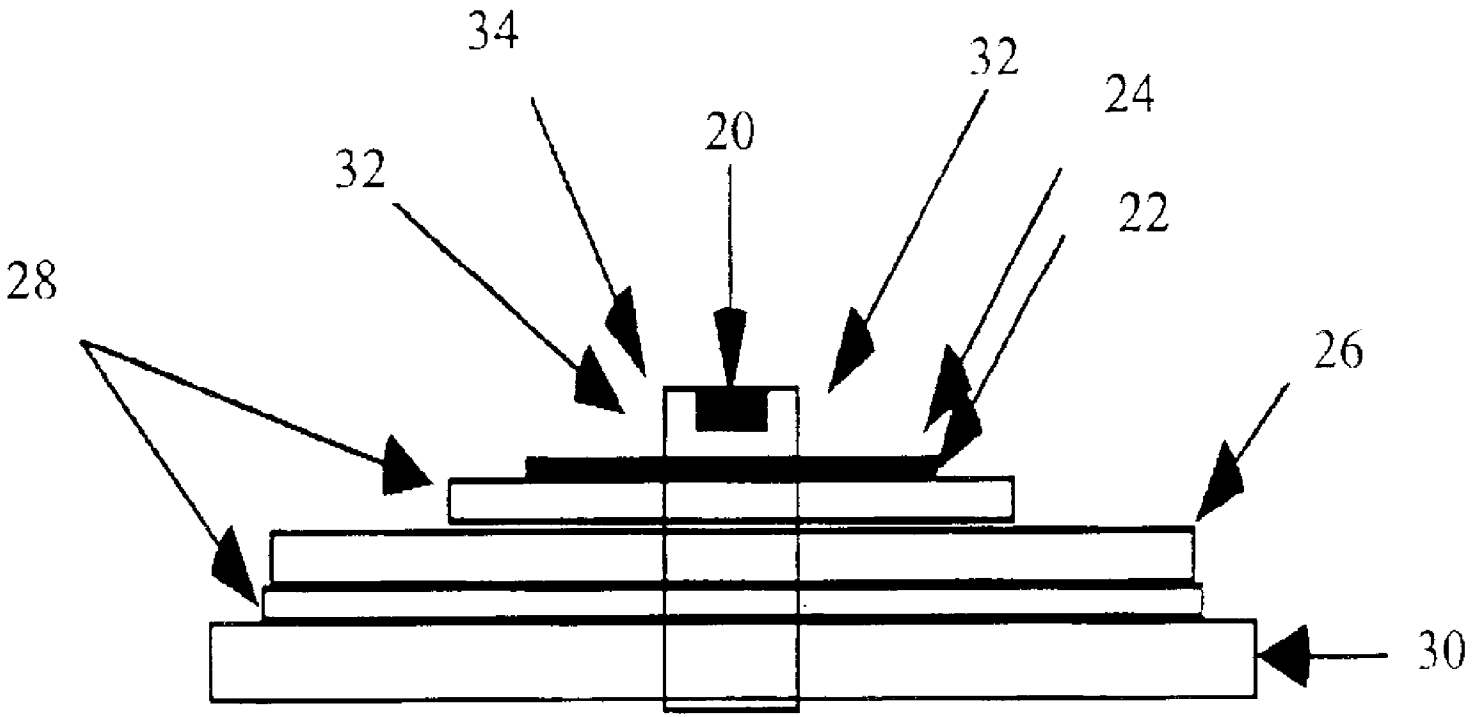
FIG. 4 is a cross sectional view of an electrical initiation test configuration according to the present invention.

Several tests were conducted to demonstrate the mechanics of the present embodiments of the electrical initiation technique. FIG. 4 illustrates a cross-sectional view of the electrical initiation test configuration. The electrical initiation system included an index card 26 layered on both sides with doubled sided tape 28 to secure a glass slide 30, the aluminized Mylar® sheet 24 and 22 including two copper conductors 32, and a MIC composition 20 fastened onto the aluminum coated side where electrically energy is applied. An aluminized Mylar® sheet 24 and 22 (~100-nm aluminum thin film on Mylar®) was cut into strips and attached to copper conductors 32 on opposite sides of the thin aluminum film 24 and 22 surface. Sufficient energy (voltage and current) is applied to the film 24 and 22 and an audible crack accompanied a blue-white flash. As a result, a portion of the aluminum was missing, much like a blown fuse link. An effective amount of energy was applied to the film to substantially vaporize the metallic film. "Substantially" vaporizing the film includes partial to full vaporization of all metals on or in the film or strip utilized in the present invention.

The amount of energy used in the above experiment was a 5000-volt power supply and a 12.5-$\mu$F capacitor capable of delivering 156.25 joules of energy. Another test was conducted using the same electrical ignition system setup described above, except that a small sample of blended Al and $MoO_3$ nanometer powders was placed on the thin aluminum film surface between the conductors and then covered with a piece of clear adhesive tape 34. When the electrical energy was applied, the sample ignited. The thickness of the metal strip or coating of metal on a combustible surface is between at least about 10 nm–1.5 $\mu$m thick which is dependent on type of metals utilized and energy applied to said system. In another embodiment, the thickness would be between at least about 50 nm to 900 nm. In another preferred embodiment, the thickness would be about 80 nm thick.

Figure 5:
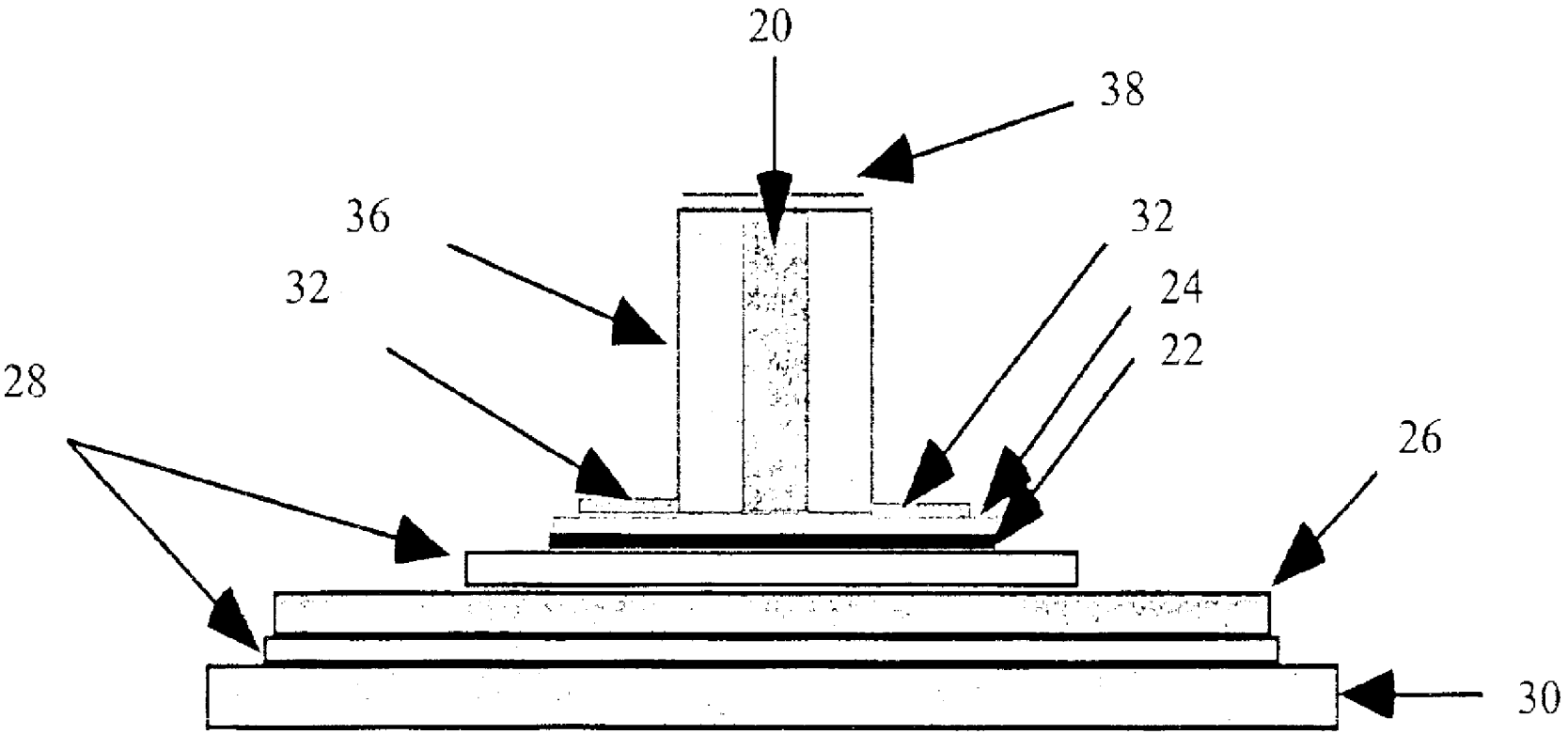
FIG. 5 is a cross sectional view of an electrical initiation test for low energy initiation and for broad-base MIC initiation test series.

Further tests of the present electrical initiation technique were performed with lower energy firing systems as shown in FIG. 5. Four test specimens including small cubes of polymethyl methacrylate (PMMA) 36 with a hole drilled through them were additionally utilized with the same components of the above tests. The small cubes 24 were configured to simulate a primer cup in an electrical initiation system. The simulated primer cup was then placed over an aluminized Mylar® strip 24 and 22 and then loaded with a small amount of MIC powders 20 (mix number NEF01-1/SF19-1) supplied by Technanogy, LLC. FIG. 5 also illustrates another test configuration with the simulated primer. The first specimen was initiated with the same high-energy system used in the above tests as a control. The remaining three specimens were initiated with successively lower energy pulses. The firing energy, voltage, and capacitance utilized during these test series are shown in Table 1. The least effective amount of energy that can be applied to the primer cup assembly is at least about 5$\mu$J. However, effective amounts of energy applied to the primer cup assembly which are higher than 5$\mu$J depend on types of metals utilized.

TABLE 1

Firing Energy Parameters.

| Test No. | Energy | Voltage | Capacitance | Ignition |
|---|---|---|---|---|
| 1 (control) | 156.25 J | 5000 | 12.5 $\mu$F | Yes |
| 2 | 400 mJ | 2000 | 200 nF | Yes |
| 3 | 100 mJ | 1000 | 200 nF | Yes |
| 4 | 25 mJ | 500 | 200 nF | Yes |

The tests described above demonstrated the initiation technique for use in electrically fired primers containing MIC materials (referred to as the Thompson Initiation Technique). However, other tests were required to prove that this technique can be employed practically in a gun system and can be manufactured in a cost-effective manner. Particular measurements that are required for application in gun systems included action time and breech pressure which are both dependent upon additional variables outside the primer. Three primer cup assemblies were constructed based mostly on current hardware that is low-cost and commercially available.

The first embodiment of the electrical initiation system 10 of the present invention is shown in FIG. 1. The construction of the primer cup assembly is based on available technologies, while only some of the components were manufactured. The metallized insulator 16 in this embodiment is the only part modified from what is currently in the market. In this embodiment the substantially non-conductive insulator 16 was metallized with aluminum and secured within the primer cup assembly without any conductive microscopy adhesives. As shown in FIG. 2, the second embodiment of the present invention 100 includes a preassembled primer cup 102, support cups 108, and button 104 similar to the first embodiment with the exception that the substantially non-conductive insulator is not metallically coated with aluminum. The primer cup assembly bridges the insulator with a thin film of aluminized Mylar® 112 that is secured (preferably glued) in place with conductive microscopy adhesives 110. One major advantage of the second embodiment is that the components can be fabricated quickly with readily available materials. FIG. 3 illustrates the third embodiment of the present invention 200 that also includes an substantially non-conductive insulator that is not metallized with aluminum and further utilizes conductive microscopy adhesives 210 to connect thin aluminized Mylar® 212 to primer cup assemblies commercially available in the market. The advantage of the third embodiment 200 is that the points of contact are strategically positioned to permit igniting the MIC composition 220 on the surface closest to the propellant. The third embodiment 200 successfully tested to desired action times and pressure profiles within a gun barrel.

RESULTS

Five inert primer cup assemblies of the all the embodiments were prepared. Two primers, one of each construction, were then loaded with MIC composition NEF01-1/SF19-1. The loading included placing 60 mg of MIC composition into each cup and then hand tamping it to approximate a 500-psi consolidation pressure. Next, the aluminized Mylar® strip was connected to the primer cup assemblies for the second and third embodiments and supports for each cup were then pressed into place. Finally, the primers were installed into cartridge cases and then fired. All embodiments fired successfully which was determined by the time of firing and the damage to the primer cup support that were extracted from the case.

Other tests were performed to verify that the initiation technique would work with a broad base of MIC compositions. Nanometer particle size metal and metal-oxide powders were blended together to produce energetic mixtures or composites described in further detail in U.S. Pat. No. 5,717,159, and is hereby incorporated by reference. A sample from each batch of materials were provided by Technanogy, LLC, and was loaded into PMMA cylinders and tested in the configuration shown in FIG. 5. Six samples were initiated with a high-energy firing system and each fired successfully. Tables 2 and 3 show the materials tested and describes any observations made. Nano aluminum (Al) was tested in three different lots of ($Al^{(1)}$, $Al^{(2)}$, or $Al^{(3)}$. Molybdenum trioxide was provided in a single lot from the Climax Company. Mogul-L carbon black and Chevron-Phillips (MIL-A-3850) acetylene black were utilized in some of the MIC compositions to simulate similar compositions used in present day lead-based explosive compositions. Additionally, polytetrafluoroethylene (Teflon®) was further added as an oxidizer to some MIC compositions and tested successfully. In Table 3, the N/A refers to method not tested due to non-conductiveness of materials in Conventional Methods.

TABLE 2

Description of Broad-base MIC Initiation Test Items.

| Test Item | Material | Load Mass, g | Ignition |
|---|---|---|---|
| 1 | NEF02-2/SF22-1 | 0.07938 | Yes |
| 2 | NEF02-4/SF24-1 | 0.07096 | Yes |
| 3 | NEF02-3/SF23-1 | 0.08280 | Yes |
| 4 | NEF02-1/SF19-2 | 0.09180 | Yes |
| 5 | NEF01-2/SF20-1 | 0.08850 | Yes |
| 6 | NEF01-1/SF19-1 | 0.09400 | Yes |

TABLE 3

Compositions of MIC samples tested.

| Test Item | Lead-free Explosive Composition | Conventional Method | Ignition with metallic strip or insulator coated |
|---|---|---|---|
| 1 | $Al^{(1)} + MoO_3$ | N/A | Yes |
| 2 | $Al^{(1)} + MoO_3$ + CB (1.2%) | No | Yes |
| 3 | $Al^{(2)} + MoO_3$ | N/A | Yes |
| 4 | $Al^{(1)} + MoO_3$ + CB (2.5%) | No | Yes |
| 5 | $Al^{(1)} + MoO_3$ + CB (4.1%) | No | Yes |
| 6 | $Al^{(1)} + MoO_3$ + AB (3.3%) | Yes | Yes |
| 7 | $Al^{(1)}$ + CuO + AB (3.3%) | No | Predictable Yes |
| 8 | $Al^{(3)} + MoO_3$ + AB (3.3%) | Yes | Predictable Yes |

The second aspect of the present invention includes a method for an electrical ignition system, including: providing a lead-free MIC composition; providing a primer cup assembly including a substantially non-conductive insulator, a metallized button, a metallized cup, and a metallized cup support; filling the primer cup with the MIC composition; providing at least one thin metallic film which is secured to the primer cup assembly wherein the film is dimensioned and configured to contact with the button, the primer cup and the MIC composition; and supplying an effective amount of electric energy which is applied to the primer cup assembly for electrical ignition. This aspect of the present invention further includes providing at least one conductive adhesive that is metallically filled (preferably silver filled) which acts to secured each thin metallic film to the inside surface of the primer cup assembly to promote bottom and/or top initiation of the MIC composition. Furthermore, another embodiment of the present invention includes the thin metallic film or strip being secured to the inner surface of the primer cup assembly without the need for any adhesives.

The apparatus and method of the electrical initiation system of the present invention is capable of igniting several different MIC material formulations, as well as many different concentration percentages of metal fuels and oxidizers, with or without carbon black or acetylene black. The manufacturing technology for producing the components is mature and is currently in widespread commercial use. Because the basic technologies upon which this initiation approach relies are mostly on available components in commercial use, the cost of production is relatively low. The by-products of the MIC compositions described in the present invention are both non-toxic and environmentally benign.

It should be understood that the examples and embodiments described herein are for illustrative purposes only and that various modifications or changes in light thereof will be suggested to persons skilled in the art and are to be included within the spirit and purview of this application and the scope of the appended claims.

We claim:

1. A lead-free electric ignition system, comprising:

a lead-free MIC composition;

a primer cup assembly including a substantially non-conductive insulator, a metallized button, a metallized cup, and a metallized cup support, said insulator including a thin formable film of metal, said thin film including aluminum, said insulator is positioned between said thin film of metal, said film is dimensioned and configured to contact with said button, said primer cup and said MIC composition, said MIC composition is filled into said primer cup assembly; and an effective amount of electric energy that is applied to said primer cup assembly to substantially vaporize said metallic film which ignites said MIC composition.

2. The electric ignition system according to claim 1, wherein said composition includes an effective amount of at least one oxidizer to oxidize at least one metal fuel.

3. The electric ignition system according to claim 2, wherein said metal fuel is selected from the group consisting of particulate $Al^1$, $Al^2$, $Al^3$, titanium, and any combination thereof.

4. The electric ignition system according to claim 2, wherein said oxidizer is selected from the group consisting of molybdenum trioxide, copper oxide, polytetrafluoroethylene, and any combination thereof.

5. The electric ignition system according to claim 1, further comprising carbon black or acetylene black.

6. The electric ignition system according to claim 1, further comprising polytetrafluoroethylene.

7. The electric ignition system according to claim 1, wherein said primer cup, said button, and said cup supports are made of a metal, or like materials.

8. The electric ignition system according to claim 1, wherein said insulator is made of a non-conducting material selected from the group consisting of polyvinylchloride, PEG, ceramic, plastic, and like materials.

9. The electric ignition system according to claim 1, wherein said thin film of metal is deposited on said surface on said insulator is between at least about 10 nm to about 1.5 $\mu$m thick which is dependent on type of metals utilized and energy applied to said system.

10. The electric ignition system according to claim 9, wherein said thin film of metal is deposited on said surface on said insulator is between at least about 50 nm to 900 nm thick.

11. The electric ignition system according to claim 9, wherein said thin film of metal is deposited on said surface on said insulator is at least about 80 nm thick.

12. The electric ignition system according to claim 1, wherein said amount of energy current applied to said primer cup assembly is at least about 5 $\mu$J.

13. A thin film electrical initiation system, comprising:

a lead-free MIC composition;

a primer cup assembly including an inner surface, an outer surface, a, a metallized button, a metallized cup, and a metallized cup support, said MIC composition is filled into said primer cup assembly;

at least one conductive adhesive;

at least one thin formable metallic film which is secured by said adhesive to said inner surface of said primer cup assembly, said film is dimensioned and configured to contact with said button, said film includes aluminum, said primer cup and said MIC composition, and an effective amount of electric energy which is applied to said primer cup assembly to substantially vaporize said metallic film which ignites said MIC composition.

14. The electrical initiation system according to claim 13, wherein said composition includes an effective amount of at least one oxidizer to oxidize at least one metal fuel.

15. The electric ignition system according to claim 14, wherein said metal fuel is selected from the group consisting of particulate $Al^1$, $Al^2$, $Al^3$, titanium, and any combination thereof.

16. The electric ignition system according to claim 14, wherein said oxidizer is selected from the group consisting of molybdenum trioxide, copper oxide, polytetrafluoroethylene, and any combination thereof.

17. The electric ignition system according to claim 13, further comprising carbon black or acetylene black.

18. The electric ignition system according to claim 13, further comprising polytetrafluoroethylene.

19. The electric ignition system according to claim 13, wherein said primer cup, said button, and said cup supports are made of a metal, or like materials.

20. The electric ignition system according to claim 13, wherein said insulator is made of a non-conducting material selected from the group consisting of polyvinylchloride, PEG, ceramic, plastic, and like materials.

21. The electric ignition system according to claim 13, wherein said thin metallic film deposit of metal(s) is on a malleable polyester film.

22. The electric ignition system according to claim 13, wherein said thin film of metal is deposited on said surface on said insulator is between at least about 10 nm to about 1.5 $\mu$m thick which is dependent on type of metals utilized and energy applied to said system.

23. The electric ignition system according to claim 22, wherein said thin film of metal is deposited on said surface on said insulator is between at least about 50 nm to 900 nm thick.

24. The electric ignition system according to claim 22, wherein said thin film of metal is deposited on said surface on said insulator is at least about 80 nm thick.

25. The electric ignition system according to claim 13, wherein said amount of energy current applied to said primer cup assembly is at least about 5 $\mu$J.

26. The electric ignition system according to claim 13, wherein said conductive adhesive is a microscopy adhesive is metallically filled.

27. The electric ignition system according to claim 25, wherein said conductive adhesive is a microscopy adhesive is silver filled.

28. The electric ignition system according to claim 13, wherein said conductive adhesive is a strategically positioned to promote bottom and/or top initiation of said MIC composition.

29. A thin film electrical initiation system, comprising:

a lead-free MIC composition;

a primer cup assembly including an inner surface, an outer surface, a substantially non-conductive insulator, a metallized button, a metallized cup, and a metallized cup support, said MIC composition is filled into said primer cup assembly;

at least one thin formable metallic film which is secured by the compression of said MIC composition into said inner surface of said primer cup assembly, said film is dimensioned and configured to contact with said button, said film includes aluminum, said primer cup and said MIC composition, and an effective amount of electric energy which is applied to said primer cup assembly to substantially vaporize said metallic film which ignites said MIC composition.

* * * * *